US009273553B2

(12) United States Patent
Gray

(10) Patent No.: US 9,273,553 B2
(45) Date of Patent: Mar. 1, 2016

(54) MINING METHOD FOR GASSY AND LOW PERMEABILITY COAL SEAMS

(76) Inventor: Ian Gray, Queensland (AU)

( * ) Notice: Subject to any disclaimer, the term of this patent is extended or adjusted under 35 U.S.C. 154(b) by 0 days.

(21) Appl. No.: 14/126,420

(22) PCT Filed: Jun. 15, 2012

(86) PCT No.: PCT/AU2012/000688
§ 371 (c)(1),
(2), (4) Date: Dec. 14, 2013

(87) PCT Pub. No.: WO2012/174586
PCT Pub. Date: Dec. 27, 2012

(65) Prior Publication Data

US 2014/0117739 A1 May 1, 2014

(30) Foreign Application Priority Data

Jun. 24, 2011 (AU) ..... 2011902475

(51) Int. Cl.

| | |
|---|---|
| ***E21C 41/00*** | (2006.01) |
| ***E21F 7/00*** | (2006.01) |
| ***E21B 43/26*** | (2006.01) |
| ***E21C 27/00*** | (2006.01) |
| ***E21C 37/06*** | (2006.01) |
| ***E21C 41/18*** | (2006.01) |

(52) U.S. Cl.
CPC . *E21F 7/00* (2013.01); *E21B 43/26* (2013.01); *E21B 43/261* (2013.01); *E21C 27/00* (2013.01); *E21C 37/06* (2013.01); *E21C 41/18* (2013.01)

(58) Field of Classification Search
CPC ..... E21F 7/00
See application file for complete search history.

(56) References Cited

U.S. PATENT DOCUMENTS

| | | | | |
|---|---|---|---|---|
| 3,650,564 | A * | 3/1972 | Williamson | 299/11 |
| 4,305,464 | A * | 12/1981 | Masszi | 166/370 |
| 4,474,409 | A * | 10/1984 | Trevits et al. | 299/16 |
| 4,978,172 | A * | 12/1990 | Schwoebel et al. | 299/12 |

FOREIGN PATENT DOCUMENTS

| | | | |
|---|---|---|---|
| CN | 101575983 | A * | 11/2009 |
| CN | 101963066 | A * | 2/2011 |

* cited by examiner

*Primary Examiner* — John Kreck
(74) *Attorney, Agent, or Firm* — Roger N Chauza, PC

(57) ABSTRACT

A method of degassing a coal seam by directionally drilling a borehole in a rock formation that is adjacent the coal seam, or between two different coal seams. The borehole is then pressurized to fracture the adjacent coal seam(s) to enhance the permeability thereof and allow fluids to flow from the coal seam to the borehole and be extracted from the coal seam.

10 Claims, 6 Drawing Sheets

MINING METHOD FOR GASSY AND LOW PERMEABILITY COAL SEAMS

BACKGROUND OF THE INVENTION

The underground mining of coal is complicated by the gas which is stored within it. If the coal seam to be mined is adequately permeable then gas is freely released from the solid coal into the roadways or into the face of the longwall mining operation. This may cause ventilation problems which if not managed properly would lead to excessive gas concentration within the mine air and the potential for an explosive gas mixture to exist.

Permeable coal may generally be relieved of its gas prior to mining by drilling holes in the virgin coal as part of a gas drainage process. These holes are frequently drilled in-seam using directional drilling techniques.

In the case where the coal lacks permeability, a different set of problems exist in mining coal. The coal does not freely drain gas ahead of the mining face and there is a risk of an outburst occurring during the mining operation. An outburst is a sudden expulsion of gas and coal from the working face of a coal mine. An outburst is characterised by the release of finely fragmented coal together with the release of gas. It is potentially fatal due to the risk of mechanical injury or asphyxiation. It has been demonstrated that outbursts cease to be a risk if the gas can be removed from the coal prior to mining. The occurrence of an outburst is not just related to the gas content but is also dependent on whether the coal has a toughness associated with it. Coats which are tough tend not to break into fine fragments which release gas quickly and are easily transported as in an outburst. Coals which are already broken up, such as with fault gouge material, are particularly prone to outbursting as they are already fragmented. Another factor which contributes to the ferocity of an outburst is the ability of the coal fragments to release or desorb gas. This is related to the diffusive behaviour of the coal material.

In addition to the problems with outbursting, impermeable coals tend to retain their gas until they are cut from the face, whereupon gas is released thus causing excessive local gas levels near the cutting heads. This may lead to frictional ignition problems.

The reason for the difference in coal permeability may be found in the coal structure itself and in the magnitude of stress within the coal. The permeability of a coal tends to reduce rapidly with increasing effective stress. Effective stress is the difference between the total stress and the fluid pressure existing within the formation—in this case coal.

Mining of very impermeable coals has taken place in Europe over many years. The approach to this has been to reduce stress by mining an adjacent seam using longwall techniques so as to cause stress relaxation and an increase in permeability of the seam to be mined, thus permitting gas to be released. The gas so released is generally captured by boreholes formed Through the relaxed seam and in the adjacent strata.

The use of this method to degas coals is limited by the ability to safely mine an initial seam. However, the initial seam needs to be one that is not prone to outbursts. This may be due to the fact that it is permeable and can be drained, but is more generally due to the coal being tough and the mining rate being slow. If a seam which is amenable to safe initial mining does not exist, then the entire coal sequence may not be able to be mined.

Recently, there have been developments in the gas industry to extract gas from highly impermeable tight coal reservoirs, and other types of reservoirs, which would hitherto have been regarded as uneconomically feasible. The key to the economic extraction of gas from such reservoirs has been the use of directional drilling within the reservoir and the stimulation of these holes generally, but not exclusively, by the use of hydrofracture. The concept of the reservoir has therefore changed from one which has both the gas and adequate permeability for it to be economically developed by more conventional means, to one where the reservoir has the gas and much of the permeability is created by stimulation. The recent development of shale gas reserves is in particular the result of this approach.

Highly impermeable coal formations often exhibit stresses which are high compared to the strength of the formations. Thus, holes drilled in such coal seams may suffer collapse rendering them useless for gas drainage purposes. Frequently holes drilled in coal are generally not amenable to stimulation, either because the well bores are either damaged due to breakage of the coal or due to the coal not having the strength to support a packer. Because the coal is to be mined, it is highly undesirable to cement a casing into the hole which can be subsequently perforated and hydrofractured. The reason for this is that the casing cannot be mined out easily.

SUMMARY OF THE INVENTION

The principles of the invention employ a unique combination of new and existing technologies. It is applicable to the situation where there is either a single seam or multiple sequences of gassy coal seams and none of the seams are permeable enough to be conventionally pre-drained using vertical or in-seam holes. To be able to develop the mine and the gateroads within the coal seam it is essential to drain the coal to avoid problems with outbursts, potential face ignition or other gas related matters.

The method by which coal can be drained is to drill either in the coal seam, or preferably in the stronger surrounding strata adjacent to the seam so that the wellbore remains intact. This drilling is preferably undertaken using directional techniques. In the case of drilling in strata adjacent to the coal seam, the borehole may be drilled with rather less deviation, as compared to a borehole which is drilled continuously in the seam, as it does not have to follow the seam precisely. The boreholes which are drilled are stimulated by the use of hydrofracture or other techniques so as to permit drainage. In the preferred case where the drilling is accomplished in the strata adjacent to the seam, the preferred stimulation technique is by hydrofracture from the borehole through the strata in which the borehole is situated, to the coal seam. The use of a proppant in the hydrofracture fluid ensures that the fracture remains open, both in the rock surrounding the coal seam and in the coal itself. Thus, the problems with borehole collapse in the coal are avoided.

By using the techniques described herein, the coal is drained of gas to a level where roadways may be driven safely in the seam. These methods may also be used to drain the coal in the longwall block. The preferred technique to degas the longwall block, when ground conditions permit, is to cut a slot in the seam between gateroads. The slot must be of adequate height (typically 150 mm) to achieve stress relaxation within the seam. It is used by itself, or in combination with a system of boreholes in the seam, or surrounding the seam, which, are used to draw gas away as the de-stressing effect of the slot takes place. The preferred method to produce the slot is by dragging a chain or cable fitted with cutters in an endless loop, between the gateroads. If the chain becomes jammed then it is possible to simply disengage it and leave it in the coal for recovery when reached during the longwall face mining process. The cutting process need not be prevented by such an event. It may be restored by drilling a hole across the longwall block, preferably using directionally controlled drilling techniques, and threading another cutting chain through the hole. An alternative embodiment of the invention is to use drill holes across the longwall block which are subsequently slotted using water jetting to de-stress the coal seam.

In one embodiment the slotting process may be carried over the full length of the longwall block. In another embodiment, the slotting may only need to be carried out for an initial part of the longwall so as to enable the longwall shearer to operate in a degassed environment. Once coal extraction is underway, sufficient crushing of the coal seam can, in the appropriate geological conditions, take place ahead of the face where the longwall releases its gas prior to mining. In such cases, the gas would be advantageously gathered by drainage holes in or surrounding the seam.

With the passage of the longwall face, stresses are relieved in the surrounding strata and seams and the permeability is dramatically improved. Gas is collected by drilling holes into this strata and by drawing it out using vacuum into a piping system so that it does not enter the mine ventilation system. The mining of other seams in the sequence may then be undertaken with the benefit that the permeability of these has been increased and that the gas has been collected from them by drainage holes which preferably operate under vacuum conditions.

DETAILED DESCRIPTION OF THE INVENTION

Figure 1:
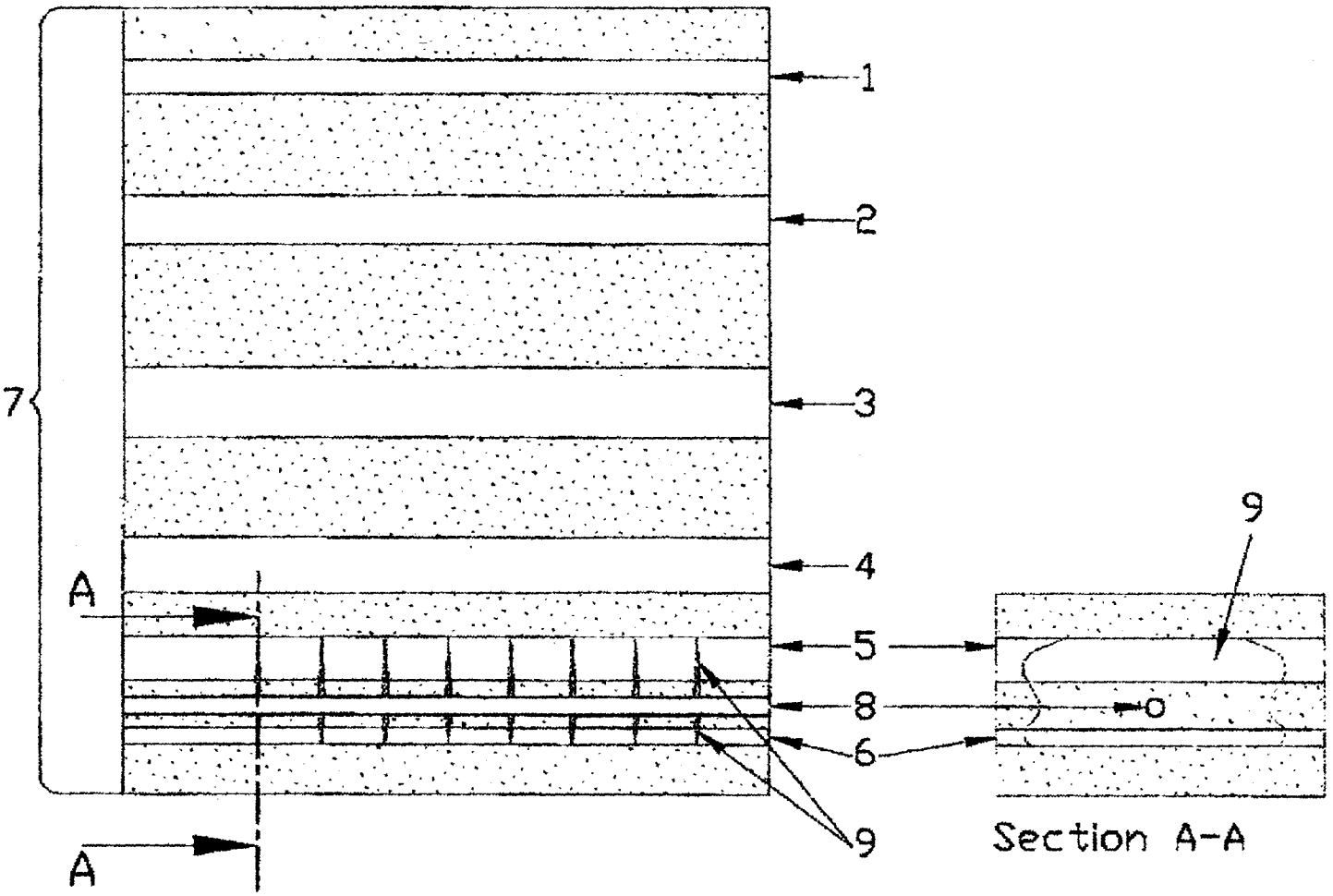
FIG. 1 shows a sequence of coal seams 1 to 6 in coal measure rocks. Seams 5 and 6 are being degassed via a borehole that has been stimulated using hydraulic fracturing. The inset shows a cross section through the borehole and the two seams reached by hydrofracturing.

FIG. 1 shows a section of a sequence of coal seams 1 to 6 in sedimentary strata sequence 7. Between the two lower seams 5 and 6, a horizontal borehole 8 has been drilled. The borehole 8 has been preferably drilled using directional drilling techniques and may have been started at the surface or from an underground location. In this case, the borehole 8 has been drilled between the seams in the horizontal rock formation which is more competent than the coal seams, and will therefore remain open. From the borehole 8, a series of hydro fractures 9 are created, which in this cast extend upwards into seam 5 and down into seam 6. The vertical hydrofractures 9 create pathways for drainage of fluid from the seams 5 and 6. It would frequently be the case that only one seam would be targeted for such drainage rather than the two seams 5 and 6 shown here. The borehole 8 may need to be pumped to lower water levels to permit the pre-drainage of gas from the seams. This is not shown in this figure. The borehole 8 can be lined with a cemented casing prior to the perforating and hydrofracturing procedures.

Figure 2:
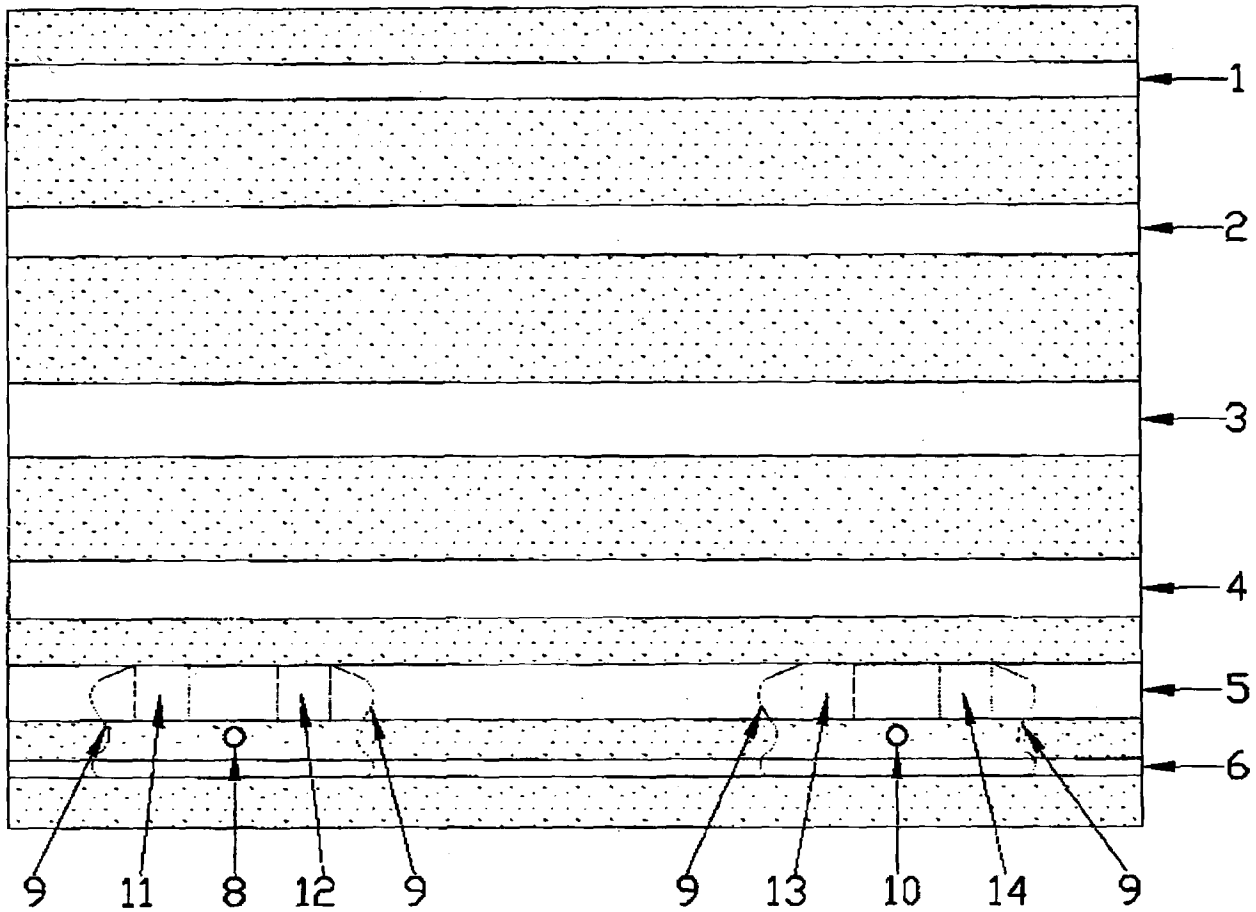
FIG. 2 shows a cross section across FIG. 1 where gateroads for a longwall panel have subsequently been driven in the area drained under the influence of hydrofracturing from boreholes drilled below them.

FIG. 2 shows a cross section through two spaced-apart boreholes 8 and 10 which have been hydrofractured 9 and where gateroads 11 to 14 for longwall mining have been driven in the drained zone of seam 5. The pre-drainage achieved by the use of the holes and hydrofracturing permits mining to take place free of high gas levels.

Figure 3:
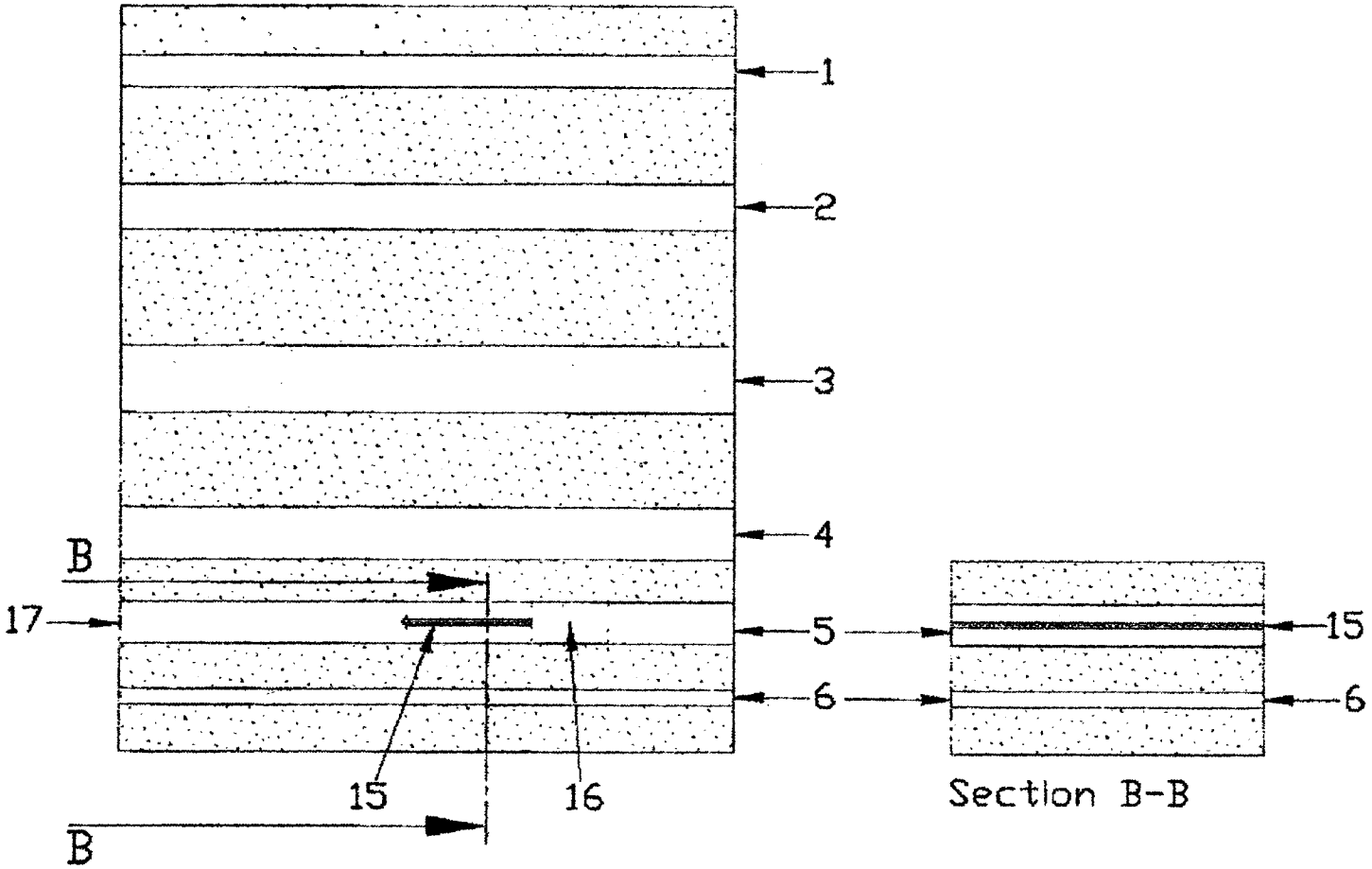
FIG. 3 shows the installation roadway which would be driven between the gateroads of the longwall with a slot being cut into the longwall block for the purpose of de-stressing the seam and improving its permeability.

FIG. 3 is a section taken between the gateroads of FIG. 2. Shown is the creation of a horizontal slot 15 in coal seam 5, from the longwall installation roadway 16 into the Longwell block 17 to be mined. The purpose of the slot 15 is to induce de-stressing of the seam 5 so that it may give up gas prior to mining. This gas is preferably collected by boreholes that are drilled either in the seam, or in the surrounding strata and from which the gas is withdrawn under vacuum conditions. These boreholes are not shown in this figure. The slot 15 can be formed by using a toothed chain or cable that is constructed so that the movement of the chain or cable is effective to cut the slot 15 in the coal seam. The cutting chain with cutters attached thereto can be constructed with links suitable to be engaged with a cogged drive wheel, or the like, which is driven by an engine or motor. Another cogged wheel can be located at the remote location in a gateroad to allow the chain to return in the opposite direction. The cogged wheel at the remote location can be of an idler type or driven. A cable with cutters attached thereto can be driven by friction means or by the use of a drive spool and a driven spool.

The slot 15 may be expected to close under the influence of stress behind where it is being cut. The inset along section B-B shows the slot 15 in seam 5. It. should be appreciated that the slot 15 may not need to be cut the full length of the longwall block 17, as once longwall mining has removed a reasonable amount of the block 17, the abutment stresses may under favourable ground conditions lead to the breakage of the coal well ahead of the longwall face, which results in increased permeability. In addition, the slot 15 can be developed by using a high pressure water jet to cut the slot 15 from boreholes drilled across a longwall block of the coal seam.

Figure 4:
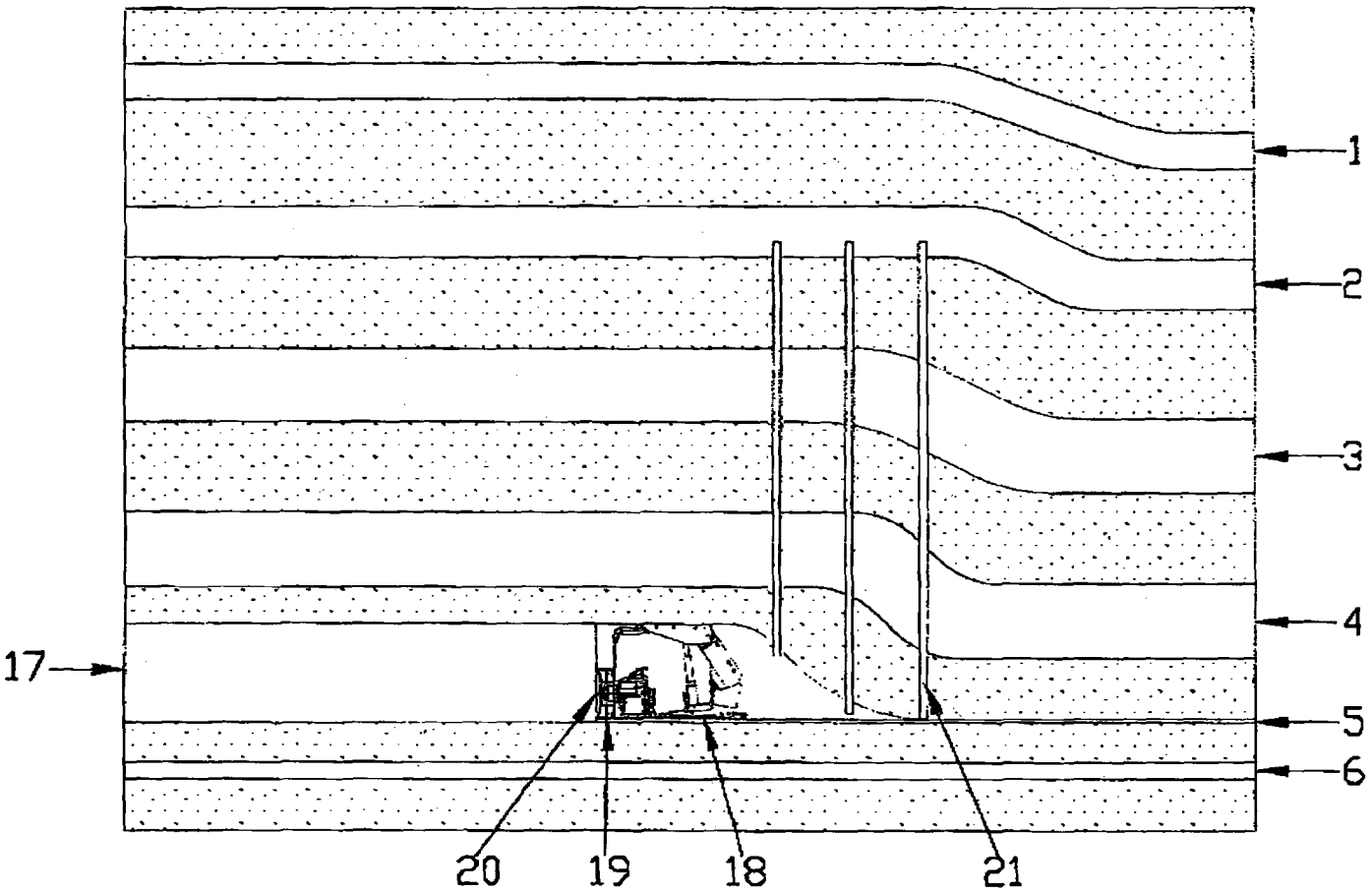
FIG. 4 shows longwall mining of seam 5 with holes drilled for drainage from the area disrupted by the removal of the seam.

FIG. 4 shows the longwall mining of longwall block 17 from seam 5 by a longwall technique using, in this case, powered support 18 and a shearer 19 which sats the face 20 of the coal seam 5. Behind the longwall are drilled goaf drainage holes 21. These drainage holes 21 are drilled from the gateroads and would normally be operated under vacuum to draw gas away from the face being cut by the shearer 19. In some instances the drainage holes 21 may be drilled ahead of the face 20 of the coal seam 5, depending on whether the effects of de-stressing take place ahead of the longwall.

Figure 5:
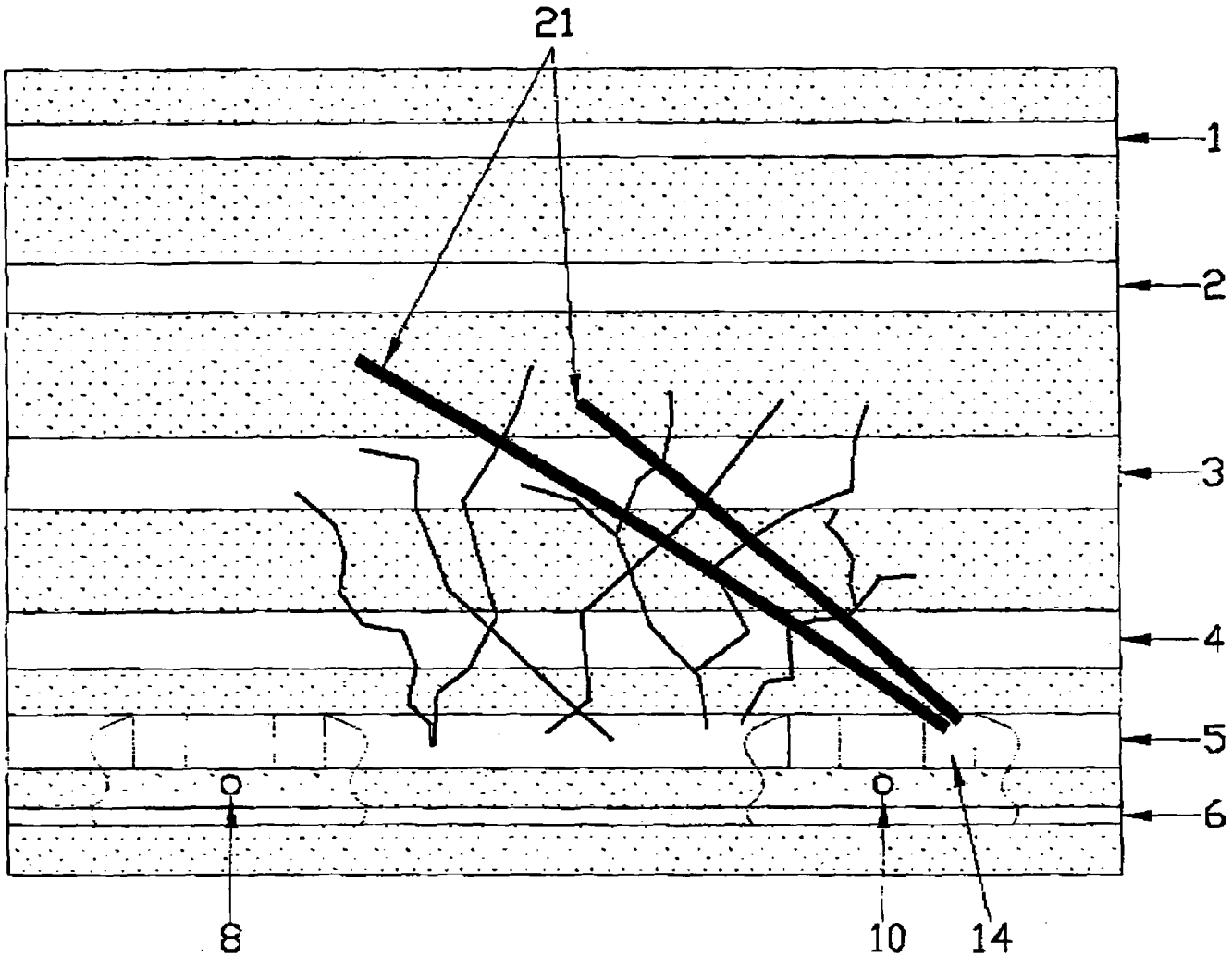
FIG. 5 shows a section through the sequence when seam 5 is being mined. It shows the goaf drainage holes which draw gas from the zone of enhanced permeability brought about by mining.

FIG. 5 shows a section taken across the longwall block and just ahead of the face 20 shown in FIG. 4. Shown is the fracturing brought about by longwall mining and the location of the goaf drainage holes 21 drilled from the outer gateroad 14. Gas is drawn into these boreholes 21 by the use of vacuum.

Figure 6:
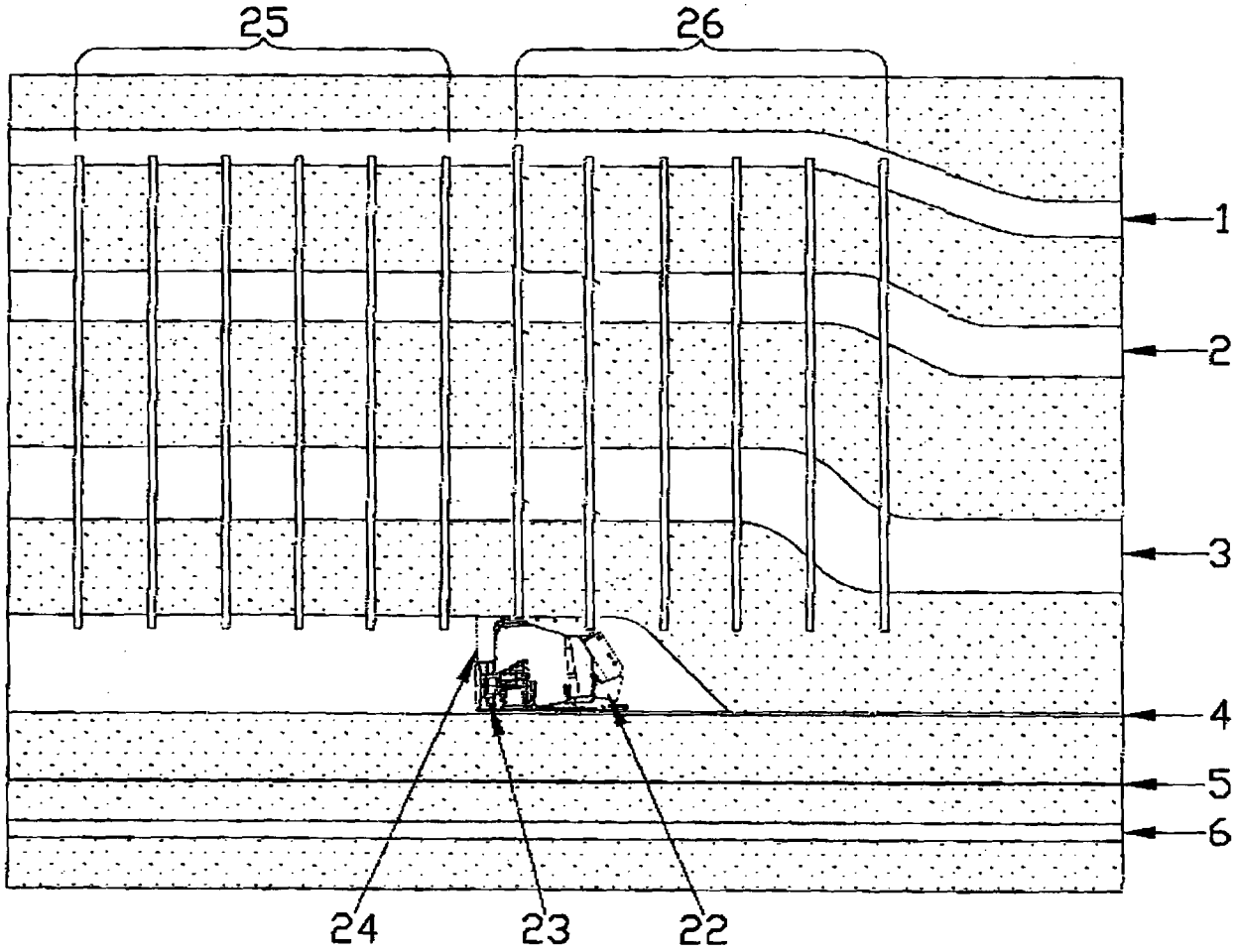
FIG. 6 shows the longwall mining of seam 4 after seam 5 is mined out. Gas is being drawn through multiple holes drilled from the gateroad.

FIG. 6 shows the longwall mining of seam 4 located above the mined out seam 5. The mining shown here is by longwall methods using powered supports 22 and shearer 23 which is cutting the face 24 of the coal seam 4. Boreholes 25 formed to drain gas from ahead of the face 24 have been drilled from the gateroads. These rely on the fracturing created by the mining of seam 5 to create permeability. Additional boreholes 26 are drilled behind the longwall face 24 to further drain after the passage of the longwall.

While the foregoing degassing of coal seams is described in connection with the fracturing of the coal seam using high pressure hydraulic equipment, the stimulation of the formation can be carried out using high energy gas fracturing techniques brought about by the generation of gas caused by the ignition of a charge with burn characteristics that are slower than an explosive. An example of a charge suitable for this process would be similar to that used in solid propellant rocket fuel with burn rate and pressure characteristics that may be designed to suit the application. The charge is located near the coal seam by installing this fuel into a pipe and pushing this pipe into the hole which is then sealed. Such a pipe or conduit may then be ignited to produce high pressure gas which escapes from weakened zones in the pipe.

The principles and concepts of the invention are applicable to the situation where a seam is to be drained which cannot be pre-drained using holes that pass'through the seam or by in-seam holes. The reasons why it is impractical to drain the seams using these techniques may be a lack of permeability of the coal without stimulation, the collapse of holes drilled in the coal, the inability to set a packer in the coal to permit stimulation and/or an inability to case the holes to permit stimulation from within the seam.

The invention involves drilling adjacent to the coal, in a formation that is of adequate strength to support a borehole during the drilling process. Preferably this hole is then fitted with a casing which is cemented in place and then perforated. If the minor principal stress in the formation is approximately parallel to the coal seam, then the hydrofracture process is used to connect the borehole to the seam. This is repeated multiple times over the length of a single borehole and in adequate numbers of boreholes to drain the seam. The hydrofracture will extend though the perforations in the casing, through the formation in which the hole is drilled and into the coal seam. As most coals have a lower modulus of elasticity than the surrounding rocks, the stress in the coal is lower and the hydrofracture will preferentially propagate into the seam. As a common practise the hydrofracture fluid would normally contain a granular proppant to prevent the fracture from dosing fully and so as to permit the flow of fluids along the fissures after the hydrofracturing process is complete.

Where the minor stress in the formation in which the borehole is drilled is not approximately parallel to the coal seam, the method of stimulation is different. In this case the stimulation fluid pressure must be sufficiently high that it will cause fractures to radiate in all directions from the borehole and thus connect to the coal seam. This is achieved by the use of high energy gas fracturing that involves the use of a charge that burns at a slower rate than an explosive charge and produces gas at a high pressure that exceeds the stress in the formation, thus leading to fracturing. In some cases it may be desirable to follow high energy gas fracturing with hydrofracturing so as to re-open the fractures created by the former and leave proppant within the fissures.

Once multiple connections between the borehole and the seam have been achieved by one of the two stimulation techniques described, or others, the pressure in the borehole is lowered so that a reverse flow of fluid can flow from the coal seam to the borehole to bring about fluid drainage.

The systems and techniques described above may be used to drain fluids in advance of the mining of underground roadways or to drain an entire longwall block. The methods can also be used in the drainage of gas for commercial purposes. To that end, while the foregoing embodiments have been described in connection with the mining of coal seams, many or all of the concepts of the invention can be employed to drain fluids, both of the gaseous or liquid type, in formations that cannot easily support boreholes, such as in hydrocarbon-producing sandstone formations, aquifers, and many other earth formations. The boreholes can be drilled into adjacent earth formations of the type that will support the integrity of the borehole, and then horizontally into the hydrocarbon-producing formation to fracture it. Indeed, the various techniques described above can, be employed to recover resources other than coal and hydrocarbon fluids, including water, minerals, etc. Thus, the use of the term 'formation' or similar, terms herein is not to be construed as being limited to a coal seam, but is intended to encompass many other formations to which the systems and techniques described above can be envisioned to be applicable.

It should be appreciated that the mining sequence may be varied to suit local ground conditions and economics so that lower or upper seams are mined after the initial seam and that the gas drainage holes may be drilled to drain both below as well as above the mined seam.

The invention claimed is:

1. A method of draining fluid from a low permeability, gassy coal seam where a borehole in the coal seam would otherwise collapse, and where the coal seam is adjacent a stronger strata which can sustain the integrity of the borehole, comprising:

forming two spaced apart boreholes in the stronger strata adjacent to and generally parallel to the coal seam to be drained of gas, without drilling the borehole into the coal seam, said boreholes defining respective gate road locations, and said gate road locations define a longwall section in the coal seam;

fracturing the coal seam at the two spaced apart locations via the boreholes to produce fractures that connect the boreholes to the coal seam and degas the two spaced apart areas in the coal seam to the borehole so that the coal seam can be drained of the gas;

said fracturing carried out by using a high pressure fluid injected into the borehole, and fracturing the boreholes multiple times at separate locations over the length of each of the boreholes;

forming respective gate roads in the spaced apart and degassed areas of the coal seam; and degassing the longwall section of the coal seam between the gate roads to provide permeability to the longwall section of the coal seam, and mining the longwall section of coal.

2. The method of claim 1, further including cementing a casing in the borehole formed in the adjacent stronger strata, and perforating the casing at locations where multiple fractures are to be initiated.

3. The method of claim 1, further including fracturing the adjacent stronger strata and the coal seam by using high energy gas fracturing brought about by expanding gas generated by the ignition of a charge with slower burn characteristics than an explosive.

4. The method of claim 1, further including degassing the longwall section of the coal seam by forming a slot therein by workmen between the gateroads to provide permeability to the longwall section of the coal seam, and mining the longwall section of coal.

5. The method of claim 1, further including degassing the coal seam via the fractures to the boreholes before mining the fractured portion of the coal seam.

6. The method of claim 1, further including forming the boreholes in adjacent stronger strata located between two coal seams so that fractures from the boreholes extend radially outwardly from the boreholes into both said coal seams.

7. The method of claim 1, further including forming the boreholes using directional drilling from a surface location so that the coal seam can be drained of gas from the surface.

8. The method of claim 7, further including drilling from the surface downwardly and then generally horizontally into the adjacent stronger strata.

9. The method of claim 4, further including drilling boreholes across the longwall block of the coal seam, and using a high pressure water jet to form a slot from the boreholes that are drilled across the longwall block of the coal seam.

10. A method of draining fluid from a low permeability, gassy coal seam where a borehole in the coal seam would otherwise collapse, and where the coal seam is adjacent a stronger strata which can sustain the integrity of the borehole, comprising:

drilling at least two spaced apart boreholes in the stronger strata adjacent to and generally parallel to the coal seam to be drained of fluid, without drilling the boreholes into the coal seam;

the space between the boreholes defines a width of a longwall section of the coal seam, and a length of the boreholes defines a length of the longwall section of the coal seam;

stimulating the adjacent stronger strata through the boreholes to produce two elongated fractured zones in the coal seam, where the fractured zones of the coal seam define a location for respective gateroads;

evacuating gas from the two elongated fractured zones of the coal seam via the fractures and via the boreholes;

forming a respective gateroad in each said fractured zone that is degassed so that workmen can operate is the degassed coal seam zones;

using the roadways to cut a slot in the longwall section between said gateroads to thereby degas the longwall section of the coal seam; and mining the longwall section of the coal seam that is degassed by said slot.

* * * * *